US012663210B2

(12) United States Patent
Han et al.

(10) Patent No.: US 12,663,210 B2
(45) Date of Patent: Jun. 23, 2026

(54) DEVICE AND METHOD FOR RECOVERING GAS WITH VARIABLE LOW-TEMPERATURE

(71) Applicant: HANGZHOU OXYGEN PLANT GROUP CO., LTD., Hangzhou City (CN)

(72) Inventors: Yisong Han, Hangzhou City (CN); Fang Tan, Hangzhou City (CN); Yunyun Jiang, Hangzhou City (CN); Fei Gao, Hangzhou City (CN); Shuai Han, Hangzhou City (CN); Xudong Peng, Hangzhou City (CN); Yunfeng Wen, Hangzhou City (CN)

(73) Assignee: HANGZHOU OXYGEN PLANT GROUP CO., LTD., Hangzhou City (CN)

( * ) Notice: Subject to any disclaimer, the term of this patent is extended or adjusted under 35 U.S.C. 154(b) by 240 days.

(21) Appl. No.: 18/587,975

(22) Filed: Feb. 27, 2024

(65) Prior Publication Data

US 2024/0295359 A1 Sep. 5, 2024

(30) Foreign Application Priority Data

Mar. 2, 2023 (CN) ..... 202310189239.7

(51) Int. Cl.
*F25J 1/00* (2006.01)
*F25J 1/02* (2006.01)

(52) U.S. Cl.
CPC ..... *F25J 1/0035* (2013.01); *F25J 1/0015* (2013.01); *F25J 1/0224* (2013.01); *F25J 1/0292* (2013.01);

(Continued)

(58) Field of Classification Search
None
See application file for complete search history.

(56) References Cited

U.S. PATENT DOCUMENTS 4,422,301 A 12/1983 Watt et al.
2020/0182542 A1 6/2020 Lin et al.
(Continued)

FOREIGN PATENT DOCUMENTS

CN 102230403 A 11/2011
CN 104961109 A 10/2015
(Continued)

*Primary Examiner* — Jenna M Maroney
(74) *Attorney, Agent, or Firm* — Proi Intellectual Property US

(57) ABSTRACT

A device for recovering variable low-temperature gas includes a low temperature stabilizing system, a compression system, an expansion refrigeration system, and a heat exchange system, which are connected to each other by pipelines, where the low temperature stabilizing system is composed of a liquid storage unit, a liquid delivery unit, a liquid jet gasification mixing unit, and a control unit, for regulating the temperature of low-temperature gas; a liquid outlet channel of the liquid storage unit is connected to a liquid inlet channel of the liquid delivery unit, a liquid outlet channel of the liquid delivery unit is connected to a liquid inlet channel of the liquid jet gasification mixing unit, and the compression system is composed of a raw material compressor and a circulating compressor; and a gas outlet channel of the raw material compressor is connected to a gas inlet channel of the circulating compressor.

4 Claims, 1 Drawing Sheet

(52) U.S. Cl.
CPC ..... *F25J 2210/42* (2013.01); *F25J 2230/42* (2013.01); *F25J 2270/42* (2013.01)

(56) References Cited

U.S. PATENT DOCUMENTS

| | | | | |
|---|---|---|---|---|
| 2021/0364230 | A1* | 11/2021 | Flavien | F25J 1/0224 |
| 2024/0295359 | A1* | 9/2024 | Han | F25J 1/0288 |

FOREIGN PATENT DOCUMENTS

| | | | | | |
|---|---|---|---|---|---|
| CN | 105333693 | A | | 2/2016 | |
| CN | 108981285 | A | | 12/2018 | |
| CN | 113028276 | A | | 6/2021 | |
| CN | 113758148 | A | | 12/2021 | |
| CN | 216868941 | U | * | 7/2022 | F25J 1/0296 |
| EP | 3095759 | A1 | | 11/2016 | |
| JP | 2005164150 | A | | 6/2005 | |
| KR | 101303656 | B1 | | 9/2013 | |
| WO | WO-2021226524 | A1 | * | 11/2021 | F25J 1/0077 |

* cited by examiner

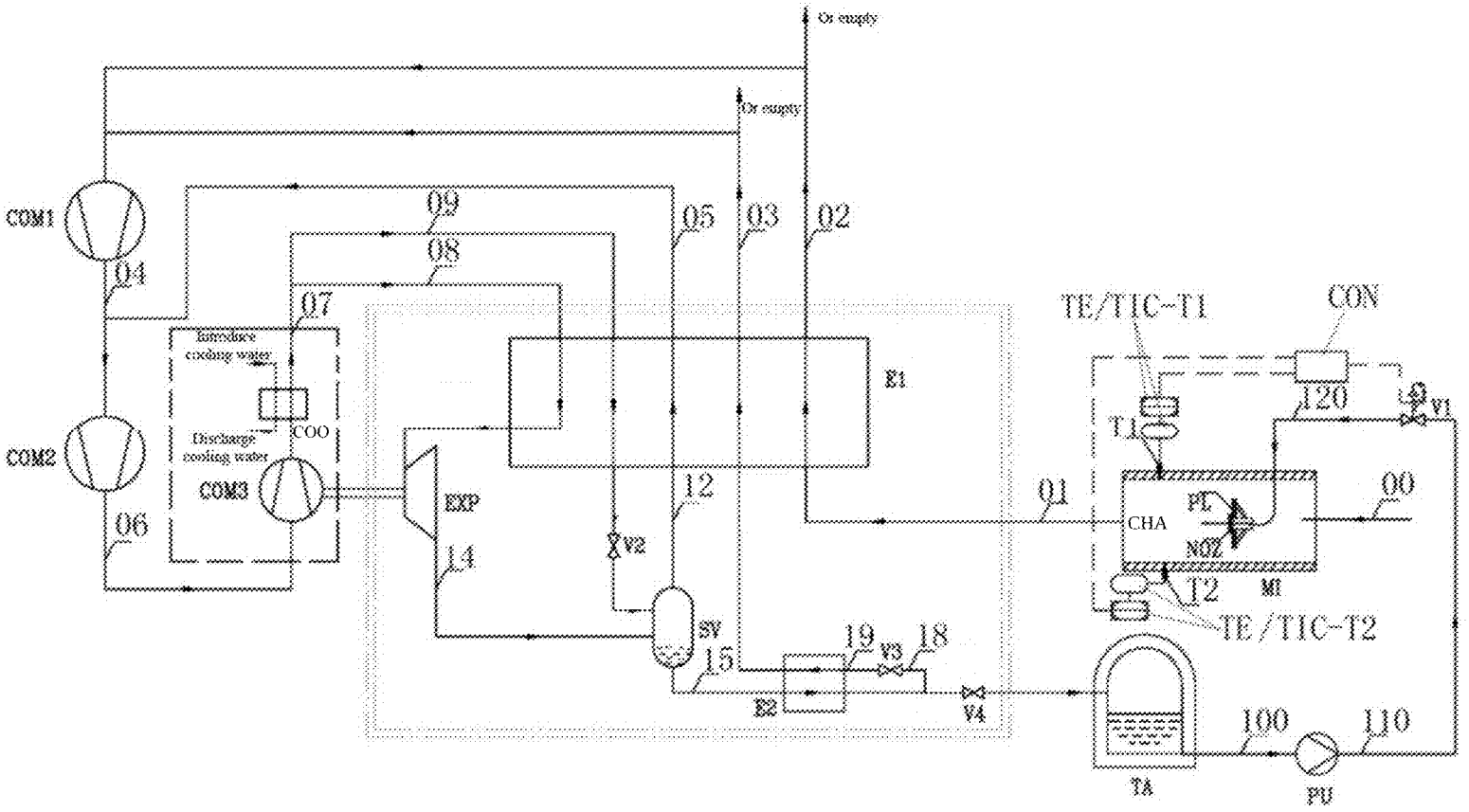
COM1
COM2
COM3
COO
EXP
CHA
CON
TE/TIC-T1
TE/TIC-T2
T1
T2
T4
P1
P2
P4
V1
V2
V3
V4
E1
E2
E3
01
02
03
04
05
06
07
08
09
10
11
12
14
15
16
17
18
19
20
100
110
120
Dry air supply
Dry air supply
Discharge cooling water
Discharge cooling water

DEVICE AND METHOD FOR RECOVERING GAS WITH VARIABLE LOW-TEMPERATURE

TECHNICAL FIELD

The present invention relates to a device for recovering gas with variable low-temperature and a method using the device, and more specifically to an energy-saving device and method for recovering gas with low-temperature by efficient coupling of a low temperature stabilizing system, a compression system, an expansion refrigeration system, and a heat exchange system to produce liquid.

BACKGROUND

Low-temperature liquid is usually used in industrial applications to dissipate heat or cool equipment. For example, in low-temperature wind tunnel tests, a Mach number required by an experiment is obtained by injecting liquid nitrogen into a wind tunnel loop and vaporizing the liquid nitrogen to absorb a large amount of heat to lower the temperature of a test environment. Therefore, the low-temperature wind tunnel discharges a lot of dry and clean low-temperature nitrogen. In order to reduce adverse effects on the surrounding environment and personnel, the low-temperature nitrogen needs to be heated and discharged at high altitudes, which causes energy waste, has a certain impact on the environment, is not conducive to the environmental protection concept of energy conservation and emission reduction, and goes against the carbon peak and carbon neutralization goal of 3060. The low-temperature nitrogen has a large cooling capacity. If a recovery device is used for liquefaction recovery, its energy consumption is lower than that of a conventional nitrogen liquefaction recovery device, so the low-temperature nitrogen has significant recovery significance. However, the temperature of gas discharged by the low-temperature wind tunnel is unstable, and varies in a temperature range of over 200K, so the discharged gas cannot be recovered by the conventional normal temperature nitrogen recovery liquefaction device. Accordingly, a device for recovering variable low-temperature gas and a method using the same are designed to overcome the above problems.

SUMMARY

The present invention aims to provide a device for recovering variable low-temperature gas and a method using the same, which can effectively achieve the recovery and utilization of low-temperature gas, and the process flow is efficient and reliable, with good economy, convenient operation and maintenance, and great promotion. Meanwhile, the device and method can recover and liquefy gases from different low-temperature zones, thereby effectively reducing unit consumption of liquid preparation.

The present invention is implemented through the following technical solution: A device for recovering variable low-temperature gas, including at least a low temperature stabilizing system, a compression system, an expansion refrigeration system, and a heat exchange system, which are connected to each other by pipelines, where the low temperature stabilizing system is composed of a liquid storage unit, a liquid delivery unit, and a liquid jet gasification mixing unit, for regulating the temperature of low-temperature gas; a liquid outlet channel of the liquid storage unit is connected to a liquid inlet channel of the liquid delivery unit, a liquid outlet channel of the liquid delivery unit is connected to a liquid inlet channel of the liquid jet gasification mixing unit, and the compression system is composed of a raw material compressor and a circulating compressor, which can be used for compressing room temperature gas; a gas outlet channel of the raw material compressor is connected to a gas inlet channel of the circulating compressor, and the expansion refrigeration system is composed of at least one booster expansion turbine to provide cooling capacity for the device; a booster end and a cooler are arranged in the booster expansion turbine, the booster end and the cooler are connected in series, an outlet of the circulating compressor is connected to an inlet channel of the booster end of the expansion turbine in the expansion refrigeration system, and an outlet channel of the booster end of the expansion turbine is connected to the heat exchange system.

As a preferred option: the heat exchange system is composed of at least one heat exchanger and a gas-liquid separator for cold recovery of low-temperature gas and heat exchange of gas liquefaction, and the outlet channel of the booster end of the expansion turbine of the expansion refrigeration system is connected to a first inlet channel and a second inlet channel of the heat exchanger of the heat exchange system; and an inlet channel of an expansion end of the booster expansion turbine is connected to a first outlet channel of the heat exchanger, a first inlet channel of the gas-liquid separator of the heat exchange system is connected to a second outlet channel of the heat exchanger through a pipeline and a first throttle valve, a second inlet channel of the gas-liquid separator is connected to an outlet channel of the expansion end of the booster expansion turbine, a first outlet channel of the gas-liquid separator is connected to a third inlet channel of the heat exchanger, a third outlet channel of the heat exchanger is connected to an inlet of the circulating compressor, and a second outlet channel of the gas-liquid separator is used for outputting a liquid product to the liquid storage unit.

As a preferred option: a first inlet channel of a liquid self-subcooler of the heat exchange system is connected to the second outlet channel of the gas-liquid separator, a first outlet channel of the liquid self-subcooler is connected to a second inlet of the liquid self-subcooler through a pipeline and a second throttle valve, a second outlet of the liquid self-subcooler is connected to a fourth inlet channel of the heat exchanger, a fourth outlet channel of the heat exchanger is connected to an inlet channel of the raw material compressor, a fifth inlet of the heat exchanger is connected to a constant low-temperature gas outlet of the liquid jet gasification mixing unit, and a fifth outlet channel of the heat exchanger is connected to the inlet channel of the raw material compressor.

As a preferred option: the liquid jet gasification mixing unit includes at least one liquid nozzle, a gasification mixing chamber, a first temperature sensor, and a second temperature sensor, a gas inlet of the liquid jet gasification mixing unit is used for receiving variable low-temperature gas, a liquid inlet channel of the liquid jet gasification mixing unit is connected to the liquid nozzle, the first temperature sensor is located at an upper middle part of the gasification mixing chamber, the second temperature sensor is located at a lower part of the gasification mixing chamber, and a baffle is mounted at an outlet of the gasification mixing chamber at the liquid nozzle to increase the uniformity of the variable low-temperature gas entering the gasification mixing chamber.

As a preferred option: a control valve is further arranged on the liquid inlet channel of the liquid jet gasification mixing unit, a first transmitter of the first temperature sensor and a second transmitter of the second temperature measuring sensor are arranged on the first temperature measuring sensor and the second temperature measuring sensor respectively, and the first transmitter and the second transmitter transmit detected temperature signals to a control unit, so as to regulate the flow rate of liquid entering the liquid jet gasification mixing unit.

A method using the foregoing device for recovering variable low-temperature gas includes the following steps:

1) regulating variable low-temperature gas into constant low-temperature gas;
2) introducing the constant low-temperature gas into the gas-liquid separator through two ways; and
3) regulating the constant low-temperature gas into room temperature gas for discharge by the gas-liquid separator.

As a Preferred Option: A Specific Regulating Process in Step 1) is as Follows

Liquid in the liquid storage unit is delivered by the liquid delivery unit and regulated by the control valve, and the regulated liquid enters the liquid inlet channel of the liquid jet gasification mixing unit, and is sprayed by the liquid nozzle and then mixed with variable low-temperature gas entering the gasification mixing chamber to form specific constant low-temperature gas.

As a Preferred Option: A Specific Regulating Process in Step 2) is as Follows

The constant low-temperature gas enters the heat exchanger via the fifth inlet of the heat exchanger and is reheated before being delivered out from the fifth outlet of the heat exchanger, all or part of the room temperature gas along with all or part of the gas delivered out from the fourth outlet of the heat exchanger enters the raw material compressor for compression, the compressed gas along with the gas delivered out from the third outlet of the heat exchanger enters the circulating compressor for compression, the compressed gas successively enters the booster end of the booster expansion turbine for boosting and the cooler for cooling, the cooled gas is divided into two parts, one part of the gas enters the first inlet channel of the heat exchanger for cooling and is extracted at the first outlet at the lower middle part of the heat exchanger before entering the expansion end of the expansion turbine for expansion, and the expanded fluid enters the gas-liquid separator; the other part of the gas enters the second inlet channel of the heat exchanger for cooling, is extracted at the second outlet at the lower part of the heat exchanger, and then enters the first throttle valve for throttling before entering the gas-liquid separator.

As a Preferred Option: A Specific Regulating Process in Step 3) is as Follows

The gas separated by the gas-liquid separator enters the heat exchanger for reheating to form room temperature gas, the liquid separated by the gas-liquid separator is subcooled by the liquid self-subcooler, then most of the liquid enters the liquid storage unit as a product, the remaining liquid is throttled by the second throttle valve, and the throttled fluid is reheated to room temperature gas by the liquid self-subcooler and the heat exchanger successively.

As a preferred option: the first temperature sensor and the second temperature sensor of the liquid jet gasification mixing unit are used for measuring the temperature of gas at the upper middle part and lower part of the gasification mixing chamber respectively, the first transmitter and the second transmitter transmit detected temperature signals to the control unit, the control unit controls the opening of the control valve to regulate the flow rate of the liquid entering the liquid nozzle, and the baffle mounted at the gasification mixing chamber is used for increasing the uniformity of variable low-temperature gas entering the gasification mixing chamber to facilitate the consistency of the temperature of the constant low-temperature gas out of the liquid jet gasification mixing unit.

Beneficial Effects of the Present Invention are as Follows

Variable low-temperature gas is regulated into constant low-temperature gas by the liquid jet gasification mixing unit, making it technically feasible to recover cold energy in the heat exchanger. A liquid product is obtained by heat exchange, boosting, and expansion. By reasonably matching the pressure with the temperature difference of the heat exchanger, the cold energy of low-temperature gas is efficiently recovered, and the energy consumption of liquid production is reduced.

The present invention can effectively reduce unit consumption of liquid production and has significant economic benefits. Taking low-temperature nitrogen with an inlet temperature of 150K and room temperature nitrogen with an inlet temperature of 313K as an example, the unit consumption of producing liquid nitrogen at the inlet temperature of 150K is about 20% less than that of 313K by calculation. Therefore, the method can effectively reduce the energy consumption of liquid nitrogen production and achieve the goal of recovering low-temperature nitrogen.

BRIEF DESCRIPTION OF THE DRAWINGS

FIG. 1 is a schematic diagram of an overall structure of the present invention.

DETAILED DESCRIPTION OF THE EMBODIMENTS

In order to make those of ordinary skill in the art understand the objectives, technical solutions, and advantages of the present invention more clearly, the present invention will be further elaborated below in conjunction with the accompanying drawings and embodiments.

In the description of the present invention, it should be understood that the orientations or position relationships indicated by the terms "upper", "lower", "left", "right", "inside", "outside", "horizontal", "vertical", etc. are based on the orientations or position relationships shown in the accompanying drawings, only for the convenience of describing the present invention, and not to indicate or imply that a device or component referred to must have a specific orientation, and therefore, the terms cannot be understood as limitations on the present invention.

The present invention will be introduced in detail below in conjunction with the accompanying drawing: As shown in FIG. 1, a device for recovering variable low-temperature gas includes at least a low temperature stabilizing system, a compression system, an expansion refrigeration system, and a heat exchange system, which are connected to each other by pipelines, where the low temperature stabilizing system is composed of a liquid storage unit TA, a liquid delivery unit PU, and a liquid jet gasification mixing unit MI, for regulating the temperature of low-temperature gas; a liquid outlet channel of the liquid storage unit TA is connected to a liquid inlet channel of the liquid delivery unit PU, a liquid outlet channel of the liquid delivery unit PU is connected to a liquid inlet channel of the liquid jet gasification mixing unit MI, and the compression system is composed of a raw material compressor COM1 and a circulating compressor COM2, which can be used for compressing room temperature gas; a gas outlet channel of the raw material compressor COM1 is connected to a gas inlet channel of the circulating compressor COM2, and the expansion refrigeration system is composed of at least one booster expansion turbine to provide cooling capacity for the device; a booster end COM3 and a cooler COO are arranged in the booster expansion turbine, the booster end COM3 and the cooler COO are connected in series, an outlet of the circulating compressor COM2 is connected to an inlet channel of the booster end COM3 of the expansion turbine in the expansion refrigeration system, and an outlet channel of the booster end COM3 of the expansion turbine is connected to the heat exchange system.

The heat exchange system is composed of at least one heat exchanger and a gas-liquid separator SV for cold recovery of low-temperature gas and heat exchange of gas liquefaction, and the outlet channel of the booster end COM3 of the expansion turbine of the expansion refrigeration system is connected to a first inlet channel and a second inlet channel of the heat exchanger E1 of the heat exchange system; and an inlet channel of an expansion end EXP of the booster expansion turbine is connected to a first outlet channel of the heat exchanger E1, a first inlet channel of the gas-liquid separator SV of the heat exchange system is connected to a second outlet channel of the heat exchanger E1 through a pipeline and a first throttle valve V2, a second inlet channel of the gas-liquid separator SV is connected to an outlet channel of the expansion end EXP of the booster expansion turbine, a first outlet channel of the gas-liquid separator SV is connected to a third inlet channel of the heat exchanger E1, a third outlet channel of the heat exchanger E1 is connected to an inlet of the circulating compressor COM2, and a second outlet channel of the gas-liquid separator SV is used for outputting a liquid product to the liquid storage unit TA.

A first inlet channel of a liquid self-subcooler E2 of the heat exchange system is connected to the second outlet channel of the gas-liquid separator SV, a first outlet channel of the liquid self-subcooler E2 is connected to a second inlet of the liquid self-subcooler E2 through a pipeline and a second throttle valve V3, a second outlet of the liquid self-subcooler E2 is connected to a fourth inlet channel of the heat exchanger E1, a fourth outlet channel of the heat exchanger E1 is connected to an inlet channel of the raw material compressor COM1, a fifth inlet of the heat exchanger E1 is connected to a constant low-temperature gas outlet of the liquid jet gasification mixing unit MI, and a fifth outlet channel of the heat exchanger E1 is connected to the inlet channel of the raw material compressor COM1.

The liquid jet gasification mixing unit MI includes at least one liquid nozzle NOZ, a gasification mixing chamber CHA, a first temperature sensor T1, and a second temperature sensor T2, a gas inlet of the liquid jet gasification mixing unit MI is used for receiving variable low-temperature gas, a liquid inlet channel of the liquid jet gasification mixing unit MI is connected to the liquid nozzle NOZ, the first temperature sensor T1 is located at an upper middle part of the gasification mixing chamber CHA, the second temperature sensor T2 is located at a lower part of the gasification mixing chamber CHA, and a baffle PL is mounted at an outlet of the gasification mixing chamber CHA at the liquid nozzle NOZ to increase the uniformity of the variable low-temperature gas entering the gasification mixing chamber CHA.

A control valve V1 is further arranged on the liquid inlet channel of the liquid jet gasification mixing unit MI, a first transmitter TE/TIC-T1 of the first temperature sensor T1 and a second transmitter TE/TIC-T2 of the second temperature sensor T2 are arranged on the first temperature measuring sensor T1 and the second temperature sensor T2 respectively, and the first transmitter TE/TIC-T1 and the second transmitter TE/TIC-T2 transmit detected temperature signals to a control unit CON, so as to regulate the flow rate of liquid entering the liquid jet gasification mixing unit MI.

A method using the foregoing device for recovering variable low-temperature gas includes the following steps:

1) regulating variable low-temperature gas into constant low-temperature gas;
2) introducing the constant low-temperature gas into the gas-liquid separator SV through two ways; and
3) regulating the constant low-temperature gas into room temperature gas for discharge by the gas-liquid separator SV.

A specific regulating process in step 1) is as follows:

Liquid 100 in the liquid storage unit TA is delivered by the liquid delivery unit PU and regulated by the control valve V1, and the regulated liquid 120 enters the liquid inlet channel of the liquid jet gasification mixing unit MI, and is sprayed by the liquid nozzle NOZ and then mixed with variable low-temperature gas 00 entering the gasification mixing chamber CHA to form specific constant low-temperature gas 01.

A specific regulating process in step 2) is as follows:

The constant low-temperature gas 01 enters the heat exchanger E1 via the fifth inlet of the heat exchanger E1 and is reheated before being delivered out from the fifth outlet of the heat exchanger E1, all or part of the room temperature gas 02 along with all or part of the gas 03 delivered out from the fourth outlet of the heat exchanger E1 enters the raw material compressor COM1 for compression, the compressed gas 04 along with the gas 05 delivered out from the third outlet of the heat exchanger E1 enters the circulating compressor COM2 for compression, the compressed gas 06 successively enters the booster end COM3 of the booster expansion turbine for boosting and the cooler COO for cooling, the cooled gas 07 is divided into two parts, one part 08 of the gas enters the first inlet channel of the heat exchanger E1 for cooling and is extracted at the first outlet at the lower middle part of the heat exchanger E1 before entering the expansion end EXP of the expansion turbine for expansion, and the expanded fluid 14 enters the gas-liquid separator SV; the other part 09 of the gas 07 enters the second inlet channel of the heat exchanger E1 for cooling, is extracted at the second outlet at the lower part of the heat exchanger E1, and then enters the first throttle valve V2 for throttling before entering the gas-liquid separator SV.

A specific regulating process in step 3) is as follows:

The gas 12 separated by the gas-liquid separator SV enters the heat exchanger E1 for reheating to form room temperature gas 05, the liquid 15 separated by the gas-liquid separator SV is subcooled by the liquid self-subcooler E2, then most of the liquid enters the liquid storage unit TA as a product via a valve V4, the remaining liquid 18 is throttled by the second throttle valve V3, and the throttled fluid 19 is reheated to room temperature gas 03 by the liquid self-subcooler E2 and the heat exchanger E1 successively.

The first temperature sensor T1 and the second temperature sensor T2 of the liquid jet gasification mixing unit MI are used for measuring the temperature of gas at the upper middle part and lower part of the gasification mixing chamber CHA respectively, the first transmitter TE/TIC-T1 and the second transmitter TE/TIC-T2 transmit detected temperature signals to the control unit CON, the control unit CON controls the opening of the control valve V1 to regulate the flow rate of the liquid entering the liquid nozzle NOZ, and the baffle PL mounted at the gasification mixing chamber CHA is used for increasing the uniformity of variable low-temperature gas entering the gasification mixing chamber CHA to facilitate the consistency of the temperature of the constant low-temperature gas 01 out of the liquid jet gasification mixing unit MI.

Described above are merely preferred specific implementations of the present invention, but the protection scope of the present invention is not limited thereto. Variations or substitutions readily conceived by any skilled person familiar with the technical field within the technical scope disclosed in the present invention shall fall within the protection scope of the present invention.

The invention claimed is:

1. A device for recovering variable low-temperature gas, comprising at least a low temperature stabilizing system, a compression system, an expansion refrigeration system, and a heat exchange system, which are connected to each other by pipelines, wherein the low temperature stabilizing system is composed of a liquid storage unit, a liquid delivery unit, and a liquid jet gasification mixing unit, for regulating the temperature of low-temperature gas; a liquid outlet channel of the liquid storage unit is connected to a liquid inlet channel of the liquid delivery unit, a liquid outlet channel of the liquid delivery unit is connected to a liquid inlet channel of the liquid jet gasification mixing unit, and the compression system is composed of a raw material compressor and a circulating compressor, which can be used for compressing room temperature gas; a gas outlet channel of the raw material compressor is connected to a gas inlet channel of the circulating compressor, and the expansion refrigeration system is composed of at least one booster expansion turbine to provide cooling capacity for the device; a booster end and a cooler are arranged in the booster expansion turbine, the booster end and the cooler are connected in series, an outlet of the circulating compressor is connected to an inlet channel of the booster end of the expansion turbine in the expansion refrigeration system, and an outlet channel of the booster end of the expansion turbine is connected to the heat exchange system; the heat exchange system is composed of at least one heat exchanger and a gas-liquid separator for cold recovery of low-temperature gas and heat exchange of gas liquefaction, and the outlet channel of the booster end of the expansion turbine of the expansion refrigeration system is connected to a first inlet channel and a second inlet channel of the heat exchanger of the heat exchange system; an inlet channel of an expansion end of the booster expansion turbine is connected to a first outlet channel of the heat exchanger, a first inlet channel of the gas-liquid separator of the heat exchange system is connected to a second outlet channel of the heat exchanger through a pipeline and a first throttle valve, a second inlet channel of the gas-liquid separator is connected to an outlet channel of the expansion end of the booster expansion turbine, a first outlet channel of the gas-liquid separator is connected to a third inlet channel of the heat exchanger, a third outlet channel of the heat exchanger is connected to an inlet of the circulating compressor, and a second outlet channel of the gas-liquid separator is used for outputting a liquid product to the liquid storage unit; a first inlet channel of a liquid self-subcooler of the heat exchange system is connected to the second outlet channel of the gas-liquid separator, a first outlet channel of the liquid self-subcooler is connected to a second inlet of the liquid self-subcooler through a pipeline and a second throttle valve, a second outlet of the liquid self-subcooler is connected to a fourth inlet channel of the heat exchanger, a fourth outlet channel of the heat exchanger is connected to an inlet channel of the raw material compressor, a fifth inlet of the heat exchanger is connected to a constant low-temperature gas outlet of the liquid jet gasification mixing unit, and a fifth outlet channel of the heat exchanger is connected to the inlet channel of the raw material compressor; the liquid jet gasification mixing unit comprises at least one liquid nozzle, a gasification mixing chamber, a first temperature sensor, and a second temperature sensor, a gas inlet of the liquid jet gasification mixing unit is used for receiving variable low-temperature gas, a liquid inlet channel of the liquid jet gasification mixing unit is connected to the liquid nozzle, the first temperature sensor is located at an upper middle part of the gasification mixing chamber, the second temperature sensor is located at a lower part of the gasification mixing chamber, and a baffle is mounted at an outlet of the gasification mixing chamber at the liquid nozzle to increase the uniformity of the variable low-temperature gas entering the gasification mixing chamber.

2. The device for recovering variable low-temperature gas according to claim 1, wherein a control valve is further arranged on the liquid inlet channel of the liquid jet gasification mixing unit (MI), a first transmitter of the first temperature sensor and a second transmitter of the second temperature sensor are arranged on the first temperature sensor and the second temperature sensor respectively, and the first transmitter and the second transmitter transmit detected temperature signals to a control unit, so as to regulate the flow rate of liquid entering the liquid jet gasification mixing unit.

3. A method using the device for recovering variable low-temperature gas according to claim 1, wherein the method comprises the following steps:

1) Regulating variable low-temperature gas into constant low-temperature gas;
2) Introducing the constant low-temperature gas into the gas-liquid separator through two ways; and
3) Regulating the constant low-temperature gas into room temperature gas for discharge by the gas-liquid separator;

a specific regulating process in step 1) is as follows:

liquid in the liquid storage unit is delivered by the liquid delivery unit and regulated by the control valve, and the regulated liquid enters the liquid inlet channel of the liquid jet gasification mixing unit, and is sprayed by the liquid nozzle and then mixed with variable low-temperature gas entering the gasification mixing chamber to form specific constant low-temperature gas;

a specific regulating process in step 2) is as follows:

the constant low-temperature gas enters the heat exchanger via the fifth inlet of the heat exchanger and is reheated before being delivered out from the fifth outlet of the heat exchanger, all or part of the room temperature gas along with all or part of the gas delivered out from the fourth outlet of the heat exchanger enters the raw material compressor for compression, the compressed gas along with the gas delivered out from the third outlet of the heat exchanger enters the circulating compressor for compression, the compressed gas successively enters the booster end of the booster expansion turbine for boosting and the cooler for cooling, the cooled gas is divided into two parts, one part of the gas enters the first inlet channel of the heat exchanger for cooling and is extracted at the first outlet at the lower middle part of the heat exchanger before entering the expansion end of the expansion turbine for expansion, and the expanded fluid enters the gas-liquid separator; the other part of the gas enters the second inlet channel of the heat exchanger for cooling, is extracted at the second outlet at the lower part of the heat exchanger, and then enters the first throttle valve for throttling before entering the gas-liquid separator;

a specific regulating process in step 3) is as follows:

the gas separated by the gas-liquid separator enters the heat exchanger for reheating to form room temperature gas, the liquid separated by the gas-liquid separator is subcooled by the liquid self-subcooler, then most of the liquid enters the liquid storage unit as a product, the remaining liquid is throttled by the second throttle valve, and the throttled fluid is reheated to room temperature gas by the liquid self-subcooler and the heat exchanger successively; and the first temperature sensor and the second temperature sensor of the liquid jet gasification mixing unit are used for measuring the temperature of gas at the upper middle part and lower part of the gasification mixing chamber respectively, the first transmitter and the second transmitter transmit detected temperature signals to the control unit, the control unit controls the opening of the control valve to regulate the flow rate of the liquid entering the liquid nozzle, and the baffle mounted at the gasification mixing chamber is used for increasing the uniformity of variable low-temperature gas entering the gasification mixing chamber to facilitate the consistency of the temperature of the constant low-temperature gas out of the liquid jet gasification mixing unit.

4. A method using the device for recovering variable low-temperature gas according to claim 2, wherein the method comprises the following steps:

1) Regulating variable low-temperature gas into constant low-temperature gas;

2) Introducing the constant low-temperature gas into the gas-liquid separator through two ways; and 3) Regulating the constant low-temperature gas into room temperature gas for discharge by the gas-liquid separator;

a specific regulating process in step 1) is as follows:

liquid in the liquid storage unit is delivered by the liquid delivery unit and regulated by the control valve, and the regulated liquid enters the liquid inlet channel of the liquid jet gasification mixing unit, and is sprayed by the liquid nozzle and then mixed with variable low-temperature gas entering the gasification mixing chamber to form specific constant low-temperature gas;

a specific regulating process in step 2) is as follows:

the constant low-temperature gas enters the heat exchanger via the fifth inlet of the heat exchanger and is reheated before being delivered out from the fifth outlet of the heat exchanger, all or part of the room temperature gas along with all or part of the gas delivered out from the fourth outlet of the heat exchanger enters the raw material compressor for compression, the compressed gas along with the gas delivered out from the third outlet of the heat exchanger enters the circulating compressor for compression, the compressed gas successively enters the booster end of the booster expansion turbine for boosting and the cooler for cooling, the cooled gas is divided into two parts, one part of the gas enters the first inlet channel of the heat exchanger for cooling and is extracted at the first outlet at the lower middle part of the heat exchanger before entering the expansion end of the expansion turbine for expansion, and the expanded fluid enters the gas-liquid separator; the other part of the gas enters the second inlet channel of the heat exchanger for cooling, is extracted at the second outlet at the lower part of the heat exchanger, and then enters the first throttle valve for throttling before entering the gas-liquid separator;

a specific regulating process in step 3) is as follows:

the gas separated by the gas-liquid separator enters the heat exchanger for reheating to form room temperature gas, the liquid separated by the gas-liquid separator is subcooled by the liquid self-subcooler, then most of the liquid enters the liquid storage unit as a product, the remaining liquid is throttled by the second throttle valve, and the throttled fluid is reheated to room temperature gas by the liquid self-subcooler and the heat exchanger successively; and the first temperature sensor and the second temperature sensor of the liquid jet gasification mixing unit are used for measuring the temperature of gas at the upper middle part and lower part of the gasification mixing chamber respectively, the first transmitter and the second transmitter transmit detected temperature signals to the control unit, the control unit controls the opening of the control valve to regulate the flow rate of the liquid entering the liquid nozzle, and the baffle mounted at the gasification mixing chamber is used for increasing the uniformity of variable low-temperature gas entering the gasification mixing chamber to facilitate the consistency of the temperature of the constant low-temperature gas out of the liquid jet gasification mixing unit.

* * * * *